US005728016A

United States Patent [19]

Hsu

[11] Patent Number: 5,728,016

[45] Date of Patent: Mar. 17, 1998

[54] HOCKEY STICK WITH REINFORCED BLADE

[75] Inventor: Saul S. Hsu, Tainan Hsien, Taiwan

[73] Assignee: Advance Sporting Goods & Wood Mfg. Corp., Tainan Hsien, Taiwan

[21] Appl. No.: 819,648

[22] Filed: Mar. 17, 1997

Related U.S. Application Data

[63] Continuation of Ser. No. 499,919, Jul. 10, 1995, abandoned.

[51] Int. Cl.[6] ..... A63B 59/14

[52] U.S. Cl. ..... 473/563; 473/344

[58] Field of Search ..... 473/463, 342, 473/344; 280/825

[56] References Cited

U.S. PATENT DOCUMENTS

| | | | |
|---|---|---|---|
| 3,982,760 | 9/1976 | Titola | 273/67 A |
| 4,392,674 | 7/1983 | Evon | 280/825 |
| 4,452,451 | 6/1984 | Dubreuil | 273/67 A |
| 4,651,990 | 3/1987 | Profit | 473/563 |
| 5,160,135 | 11/1992 | Hasegawa | 273/67 A |
| 5,294,113 | 3/1994 | Ladouceau | 473/563 |

FOREIGN PATENT DOCUMENTS

| | | | |
|---|---|---|---|
| 459578 | 9/1949 | Canada | 273/67 A |
| 2633841 | 1/1990 | France | 273/67 A |
| 846673 | 8/1960 | United Kingdom | 273/67 A |

*Primary Examiner*—Theatrice Brown

*Attorney, Agent, or Firm*—Morton J. Rosenberg; David I. Klein; Jun Y. Lee

[57] ABSTRACT

A hockey stick has a reinforced hockey blade which is equipped with a plastic bumper secured to the bottom edge thereof and a layer of glass fiber is coated on the surface of the blade by heat hardening art. Such processed hockey stick is flexible and durable against violent impact or collision in operation, making the operation life thereof longer.

1 Claim, 3 Drawing Sheets

C-C Section

D-D Section

HOCKEY STICK WITH REINFORCED BLADE

This is a continuation of application(s) Ser. No. 08/499,919 filed on 10 Jul. 1995 now abandoned.

BACKGROUND OF THE INVENTION

The present invention relates to an improved hockey stick having a reinforced blade to which is attached a plastic bumper integrally formed by way of plastic injection molding at the bottom edge thereof; the blade is coated with a layer of glass fiber which is secured in place to the blade by way of heat hardening art. Such processed hockey stick is flexible and durable against violent impact or collision and has longer operation life. Referring to FIGS. 1, 1A, 1B, 2, a common and conventional hockey stick has a blade 1 simply made of wood and having a tennon joint 12 disposed at the top end thereof with a metallic stick 13 engaged therewith by way of adhesive glue.

The weak points of such conventional hockey stick locate at the junction of the tenon joint 12 and the blade 1, as illustrated in FIG. 1A, and the front section of the blade 1, as illustrated in FIG. 1B. When a hockey stick is violently swung and hits directly against ground or ice, or hockey sticks collide into one another in a hockey game, the wooden blade is easily broken at these points.

SUMMARY OF THE INVENTION

Therefore, the primary object of the present invention is to provide an improved hockey stick having a reinforced blade.

Another object of the present invention is to provide an improved hockey stick having a blade which is equipped with a plastic bumper integrally formed by way of injection molding and secured to the bottom edge of the blade. Besides, the blade is coated with a layer of glass fiber which is fixed in place by heat hardening art.

DETAILED DESCRIPTION OF THE PREFERRED EMBODIMENT

Figures 1, 1A, 1B:
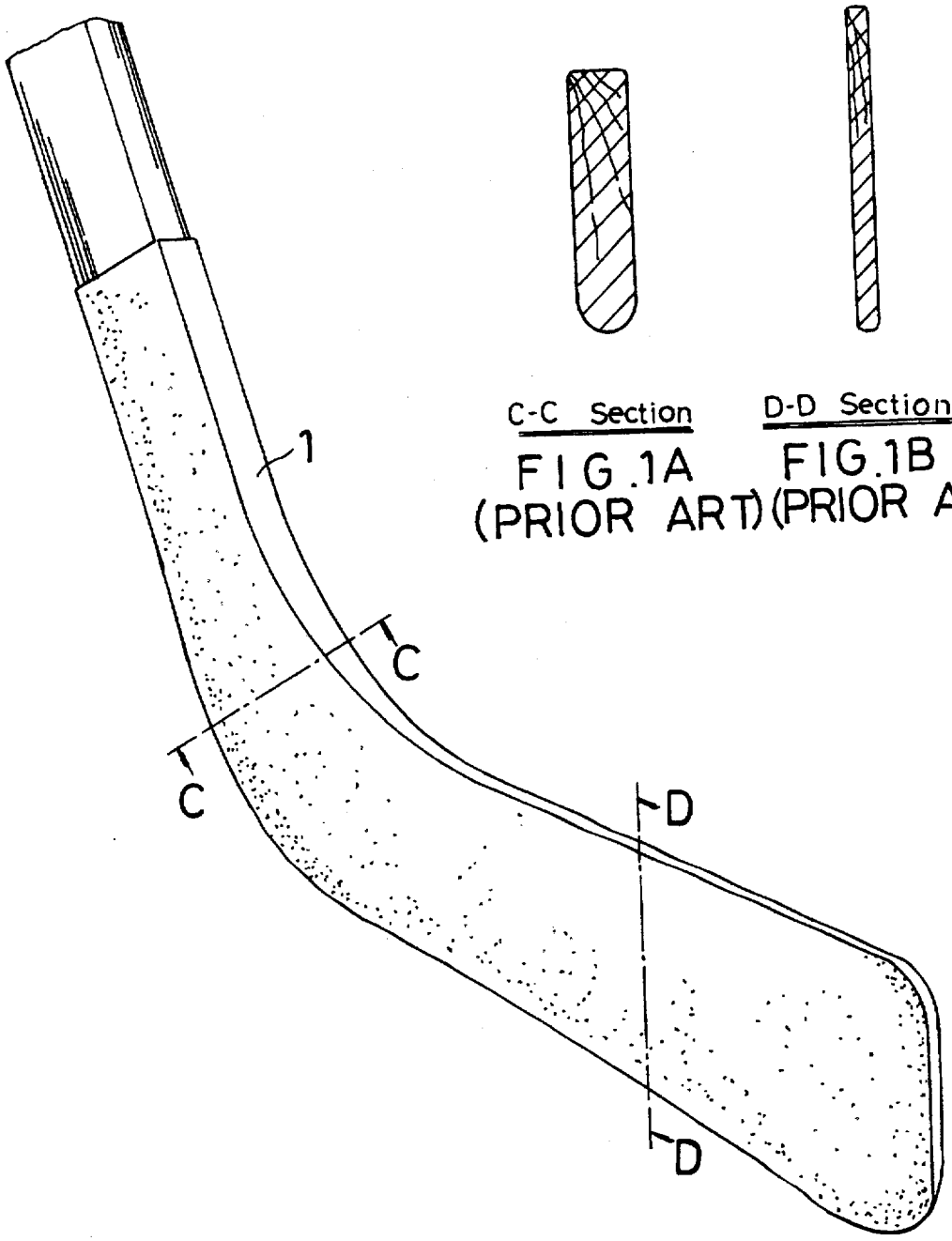
FIG.1A (PRIOR ART)
FIG.1B (PRIOR ART)
FIG.1 (PRIOR ART)
FIG. 1 is a diagram showing a conventional hockey stick having a wooden blade.
FIG. 1A shows a cross section along line I—I at the junction of the blade and the tenon joint of a conventional hockey stick.
FIG. 1B shows a cross section along line II—II of the wooden blade of the hockey stick in FIG. 1.
Figure 2:
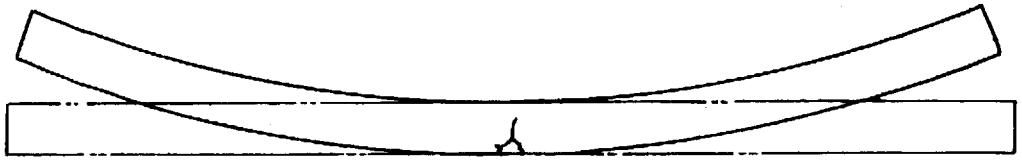
FIG. 2 (PRIOR ART)
FIG. 2 shows the deformation of a conventional wooden blade shown in FIG. 1.
Figures 3, 3A:
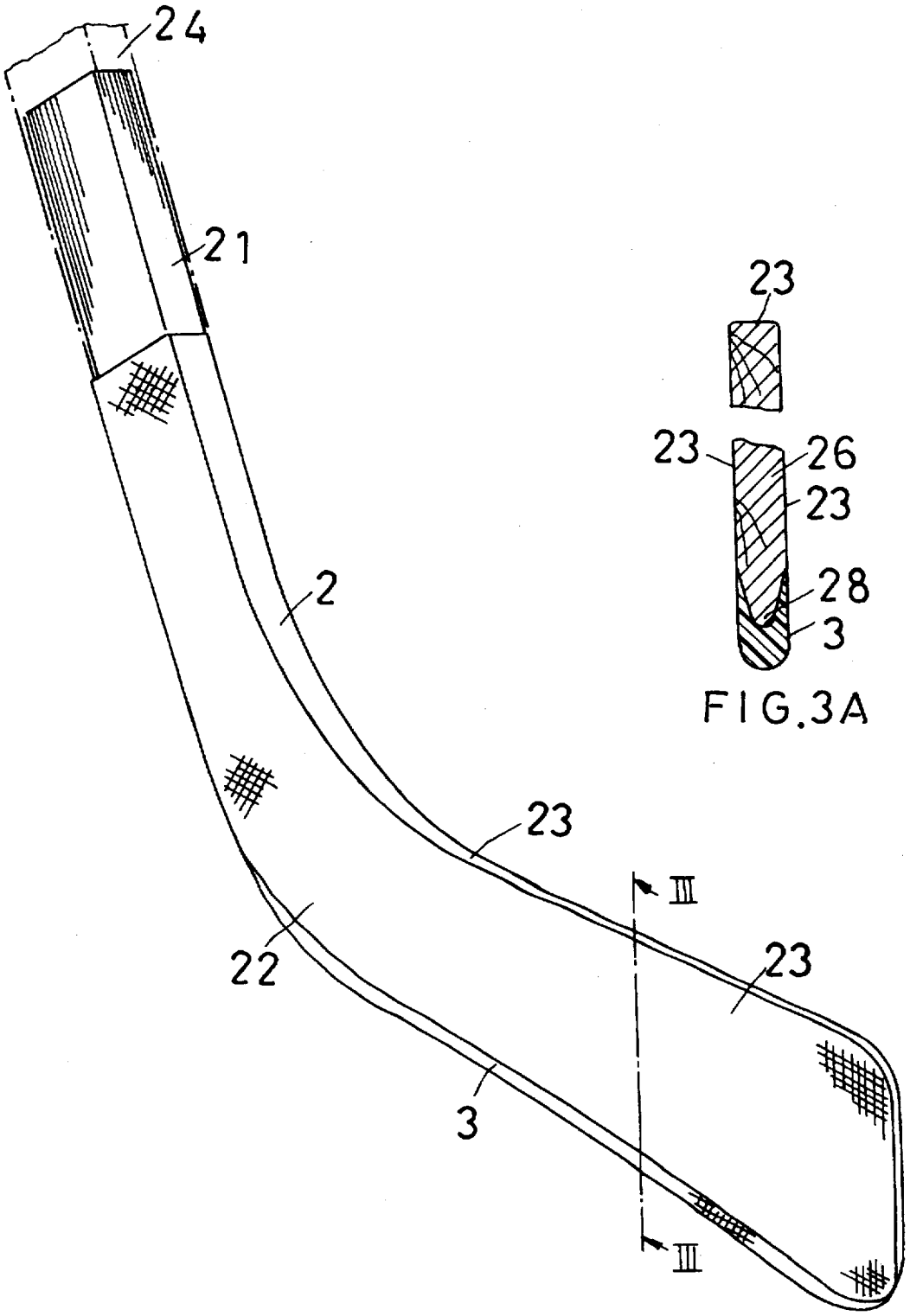
FIG. 3 is a diagram showing the improved hockey stick of the present invention.
FIG. 3A is shows the cross section along line III—III of the reinforced blade of the present invention.

Referring to FIG. 3, the blade 2 of a hockey stick has a tenon joint 21 at the top end thereof which is slightly smaller than the end of the blade 2 so that it can be fixedly engaged with a metallic stick 24 by way of glue. The hockey blade 2 is gradually reduced in its crossed area from the heel 22 to the striking face.

A plastic bumper 3 made from injection molding is secured to the V-shaped bottom edge 28 of the blade 2, as shown in FIG. 3A, by adhesive glue in such a manner that the bumper 3 and the blade 2 are integrated as one.

On the whole outer surface of the wood core 26 of blade 2 of the hockey stick, except the bottom edge having a plastic bumper 3 secured thereto, is coated with a layer of glass fiber 23 which is firmly attached to the blade by way of heat hardening art. Such processed blade 2 of a hockey stick is flexible and durable against hard and instant impact when operated at high speed. The operation life of the hockey stick of the present invention is accordingly enhanced.

The improved hockey stick of the present invention has the following advantages:

1. When a player misses hitting a hockey ball in a field or ice hockey, the hockey blade hitting hard against ground or ice will be protected by the plastic bumper from damage as a result of impact.
2. The glass fiber coated blades can be better protected from breaking up when hockey sticks operated by players in a game collide in a violent manner.

I claim:

1. A hockey stick having a reinforced blade attached to a handle, the reinforced blade comprising:

a) a blade having a v-shaped bottom edge;

b) a plastic bumper adhesively bonded to the V-shaped bottom edge of the blade; and c) glass fiber material coating the whole outer surface of the blade except the V-shaped bottom edge to which is attached the plastic bumper.

* * * * *